US009200580B2

(12) United States Patent
Brandt

(10) Patent No.: US 9,200,580 B2
(45) Date of Patent: Dec. 1, 2015

(54) METHOD AND DEVICE FOR OPERATING AN INJECTION VALVE

(75) Inventor: Martin Brandt, Wörth a.d. Donau (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 749 days.

(21) Appl. No.: 13/265,624

(22) PCT Filed: Mar. 30, 2010

(86) PCT No.: PCT/EP2010/054207
§ 371 (c)(1),
(2), (4) Date: Oct. 21, 2011

(87) PCT Pub. No.: WO2010/121892
PCT Pub. Date: Oct. 28, 2010

(65) Prior Publication Data

US 2012/0031378 A1 Feb. 9, 2012

(30) Foreign Application Priority Data

Apr. 21, 2009 (DE) ..... 10 2009 018 289

(51) Int. Cl.
*F02B 3/00* (2006.01)
*F02B 3/06* (2006.01)
*F02D 41/20* (2006.01)
*F02D 41/12* (2006.01)
(Continued)

(52) U.S. Cl.
CPC ..... *F02D 41/2096* (2013.01); *F02D 41/2467* (2013.01); *F02D 41/123* (2013.01);
(Continued)

(58) Field of Classification Search
CPC ..... F02C 2041/389; F02C 2041/2003; F02D 41/20; F02D 41/22; F02D 41/30; F02D 41/2467; F02D 41/2096; F02D 2200/0602; F02D 2041/2051; F02M 51/0603; F02M 51/061; F02B 3/06
USPC ..... 123/478, 295, 299, 305, 490, 673; 239/585.1; 701/103; 73/114.45–114.51
See application file for complete search history.

(56) References Cited

U.S. PATENT DOCUMENTS 6,401,703 B1 * 6/2002 Mamiya et al. ..... 123/674
6,742,505 B2 6/2004 Liskow ..... 123/480
(Continued)

FOREIGN PATENT DOCUMENTS

DE 10012607 A1 9/2001 ..... H02N 2/06
DE 10149960 C1 2/2003 ..... F02D 41/20
(Continued)

OTHER PUBLICATIONS

International PCT Search Report, PCT/EP2010/054207, 15 pages, Jul. 22, 2010.

*Primary Examiner* — Hai Huynh
*Assistant Examiner* — Gonzalo Laguarda
(74) *Attorney, Agent, or Firm* — Slayden Grubert Beard PLLC

(57) ABSTRACT

In a method for operating an injection valve having a longitudinal axis, an injection needle, a control valve and an actuator embodied as a solid body actuator, wherein the actuator acts on the control valve and the control valve acts on the injection nozzle, various pre-defined quantities of electrical energy are supplied to the actuator in a plurality of adaptation flows in order to modify an axial length of the actuator. This electrical energy is defined such that an axial position of the injection nozzle remains unchanged. In correlation with the respective adaptation flow, and following the energy supply associated with the respective adaptation flow, a first and second voltage value are detected and a voltage differential value is then determined which is compared with a pre-defined threshold value and, on the basis of the comparison, at least one control of the actuator is adapted to the injection of fluid.

20 Claims, 6 Drawing Sheets

(51) Int. Cl.
*F02D 41/14* (2006.01)
*F02D 41/24* (2006.01)
*F02M 51/06* (2006.01)

(52) U.S. Cl.
CPC ..... *F02D41/1402* (2013.01); *F02D 41/2441* (2013.01); *F02D 2041/2051* (2013.01); *F02M 51/0603* (2013.01)

(56) References Cited

U.S. PATENT DOCUMENTS

| | | | | |
|---|---|---|---|---|
| 6,907,864 | B2 * | 6/2005 | Takemoto | 123/478 |
| 7,095,599 | B2 * | 8/2006 | Maekawa et al. | 361/152 |
| 7,318,419 | B2 | 1/2008 | Dietl et al. | 123/478 |
| 7,406,952 | B2 | 8/2008 | Frank et al. | 123/498 |
| 7,905,136 | B2 | 3/2011 | Sutter et al. | 73/114.51 |

FOREIGN PATENT DOCUMENTS

| | | | | |
|---|---|---|---|---|
| DE | 102005001498 | A1 | 7/2006 | F02D 41/20 |
| DE | 102006055259 | * | 5/2008 | |
| DE | 102006055259 | A1 | 5/2008 | H02N 2/06 |
| EP | 1860312 | | 11/2007 | F02D 41/20 |
| EP | 2022969 | A2 | 2/2009 | F02D 41/12 |
| WO | 2005/080778 | A1 | 9/2005 | F02B 41/40 |
| WO | 2005/119038 | A1 | 12/2005 | F02D 41/20 |

* cited by examiner

METHOD AND DEVICE FOR OPERATING AN INJECTION VALVE

CROSS-REFERENCE TO RELATED APPLICATIONS

This application is a U.S. National Stage Application of International Application No. PCT/EP2010/054207 filed Mar. 30, 2010, which designates the United States of America, and claims priority to DE Application No. 10 2009 018 289.6 filed Apr. 21, 2009, the contents of which are hereby incorporated by reference in their entirety.

TECHNICAL FIELD

The invention relates to a method and to a device for operating an injection valve having a nozzle needle, a control valve and an actuator which is embodied as a solid actuator. The actuator is designed to act on the control valve, and the control valve is designed to act on the nozzle needle. The nozzle needle is designed, in a closed position, to prevent a flow of fluid through at least one injection opening and otherwise to enable the flow of fluid.

BACKGROUND

Indirectly driven injection valves have a nozzle needle, a control valve and an actuator. In order to meter a supply of fuel into a cylinder of an internal combustion engine, the injection valve can be opened or closed by actuation of the nozzle needle by means of the control valve. A precondition for an accurate metering capability of the fuel into the respective cylinder by means of the injection valve is precise knowledge about the opening behavior thereof.

SUMMARY

According to various embodiments, a method and a device can be provided for which precise and reliable injection of fluid is made possible.

According to an embodiment, a method for operating an injection valve having a longitudinal axis, an nozzle needle, a control valve and an actuator which is embodied as a solid actuator, wherein the actuator is designed to act on the control valve, and the control valve is designed to act on the nozzle needle, wherein the nozzle needle is designed to prevent, in a closed position, a flow of fluid through at least one injection opening and otherwise to enable the flow of fluid, comprises:

- feeding different predefined quantities of electrical energy to the actuator in a plurality of adaptation passes in order to change an axial length of the actuator, wherein the respective predefined quantity of electrical energy is predefined in such a way that an axial position of the nozzle needle remains unchanged,
- in a way which correlates with the respective adaptation pass, after the predefined quantity of electrical energy which is assigned to the respective adaptation pass has been fed in, detecting a first and second voltage value across the actuator,
- determining a voltage difference value as a function of the first and second voltage values,
- comparing the voltage difference value with a predefined threshold value, and
- adapting at least one actuation of the actuator for injecting fluid as a function of the comparison.

According to a further embodiment, in a way which correlates with the respective adaptation pass, in succession

- during a charging phase the predefined quantity of electrical energy which is assigned to the respective adaptation pass is fed to the actuator,
- during a holding phase for a predefined time period the feeding in of a further quantity of electrical energy is stopped, wherein the first and second voltage values are detected during the holding phase, and
- the actuator is discharged during a discharge phase.

According to a further embodiment, the first voltage value can be detected at a first time which is directly after the charging phase. According to a further embodiment, the second voltage value can be detected at a second time at which an oscillation of a movement of the control valve which is excited by means of the actuator has essentially decayed during the holding phase. According to a further embodiment, a fault in the actuator can be detected if the determined voltage difference is smaller in absolute value than the predefined threshold value and if the quantity of electrical energy which is fed to the actuator is larger in absolute value than a predefined maximum energy value. According to a further embodiment, during or after the adaptation pass in which the predefined threshold value is reached or exceeded in absolute value, an energy offset value can be determined as a function of the quantity of electrical energy which is assigned to this adaptation pass, which energy offset value is taken into account for the actuation of the actuator in order to inject fluid and/or for the actuation of the actuator during subsequent adaptation passes. According to a further embodiment, the quantity of electrical energy which is respectively fed to the actuator can be increased in successive adaptation passes. According to a further embodiment, the injection valve can be coupled hydraulically to a high pressure accumulator in order to feed in fluid, wherein the adaptation passes are started if the pressure at which the fluid is stored in the high pressure accumulator has a predefined pressure. According to a further embodiment, during the adaptation passes, the pressure in the high pressure accumulator may have essentially constantly the predefined pressure. According to a further embodiment, the threshold value can be predefined as a function of the predefined pressure.

According to another embodiment, a device for operating an injection valve having a longitudinal axis, a nozzle needle, a control valve and an actuator which is embodied as a solid actuator, wherein the actuator is designed to act on the control valve, and the control valve is designed to act on the nozzle needle, wherein the nozzle needle is designed, in a closed position, to prevent a flow of fluid through at least one injection opening and otherwise to enable the flow of fluid, may be designed

- to feed different predefined quantities of electrical energy to the actuator in a plurality of adaptation passes, in order to change an axial length of the actuator, wherein the respective predefined quantity of electrical energy is predefined in such a way that an axial position of the nozzle needle remains unchanged,
- to detect a first and second voltage value across the actuator in a way which correlates with the respective adaptation pass after the predefined quantity of electrical energy which is assigned to the respective adaptation pass has been fed in,
- to determine a voltage difference value as a function of the first and second voltage values,
- to compare the voltage difference value with a predefined threshold value, and to adapt at least one actuation of the actuator for injecting fuel as a function of the comparison.

BRIEF DESCRIPTION OF THE DRAWINGS

Exemplary embodiments are explained in more detail below with reference to the schematic drawings, in which.

Elements with the same design or function are provided with the same reference symbols throughout the figures.

DETAILED DESCRIPTION

Figure 1:
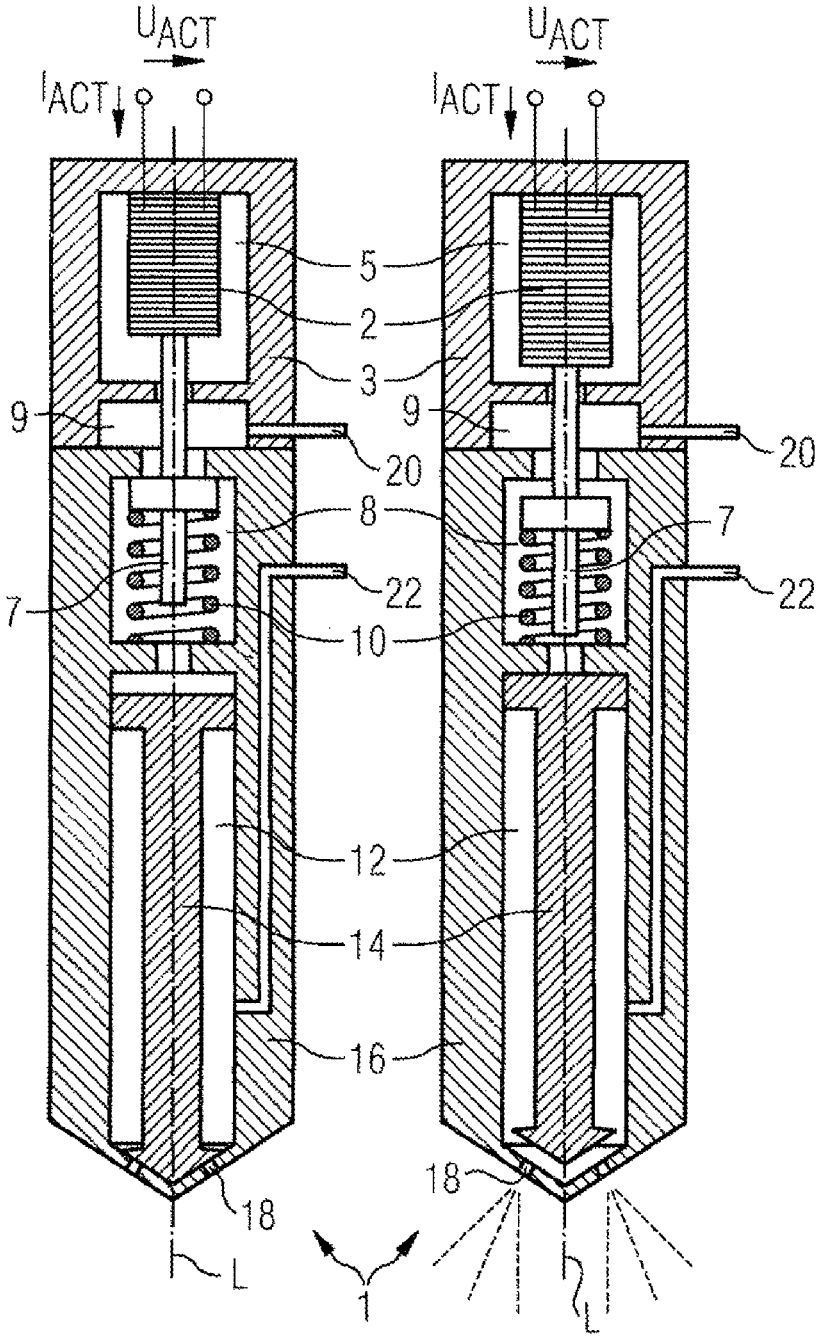
FIG. 1 shows an injection valve in longitudinal section.

According to various embodiments, a method and a corresponding device for operating an injection valve having a longitudinal axis, a nozzle needle, a control valve and an actuator which is embodied as a solid actuator can be provided. The actuator is designed to act on the control valve, and the control valve is designed to act on the nozzle needle. The nozzle needle is designed to prevent, in a closed position, a flow of fluid through at least one injection opening and otherwise to enable the flow of fluid. Different predefined quantities of electrical energy are fed to the actuator in a plurality of adaptation passes in order to change an axial length of the actuator. The respective predefined quantity of electrical energy is predefined in such a way that an axial position of the nozzle needle remains unchanged. In a way which correlates with the respective adaptation pass, after the predefined quantity of electrical energy which is assigned to the respective adaptation pass has been fed in, a first and second voltage value across the actuator are detected. A voltage difference value is determined as a function of the first and second voltage values. The voltage difference value is compared with a predefined threshold value. At least one actuation of the actuator for injecting fluid is adapted as a function of the comparison. Changes in an injection behavior of the injection valve, owing, for example, to mechanical tolerances or inflow behavior or wear which changes over the service life of the injection valve are compensated by means of the adaptation of the actuator, and reliable operation is therefore made possible. The actuator is preferably embodied as a piezo actuator and is preferably mechanically coupled to the control valve. The control valve preferably acts on the nozzle needle across a hydraulic coupling. The different quantities of electrical energy are predefined in such a way that the nozzle needle preferably remains in its closed position, and injection of fluid during the adaptation passes is therefore prevented. The quantity of electrical energy for the respective first adaptation pass is preferably predefined in such a way that the axial position of the control valve remains unchanged. This has the advantage that the adaptation of the actuator can be carried out in a particularly efficient and resource-saving fashion. The first and second voltage values are detected at respectively different, predefined times. No further measuring device is necessary for the adaptation of the actuation of the actuator.

In one embodiment, in succession during a charging phase the predefined quantity of electrical energy which is assigned to the respective adaptation pass is fed to the actuator. Then, during a holding phase for a predefined time period the feeding in of a further quantity of electrical energy is stopped, wherein the first and second voltage values are detected during the holding phase. Then the actuator is discharged during a discharge phase. The respective adaptation pass, is therefore assigned a charging phase, a holding phase and a discharging phase. This has the advantage that at the start of the respective adaptation pass the actuator is essentially discharged, and particularly precise adaptation of the actuator is therefore made possible.

In a further embodiment, the first voltage value is detected at a first time which is directly after the charging phase. At the end of the charging phase, a voltage across the actuator is particularly high, as a result of which the voltage difference value can be detected in a particularly suitable way.

In a further embodiment, the second voltage value is detected at a second time at which an oscillation of a movement of the control valve which is excited by means of the actuator has essentially decayed during the holding phase. For this purpose, a signal which is representative of the voltage across the actuator is observed and on the basis thereof an essentially decayed movement of the control valve is detected. Alternatively, after the time when the first voltage value is detected the device waits for a predefined time period and the second voltage value is then detected. The time period is determined, for example, in a test bench and represents a settling time period of the movement of the control valve.

In a further embodiment, a fault in the actuator is detected if the determined voltage difference is smaller in absolute value than the predefined threshold value and if the quantity of electrical energy which is fed to the actuator is larger in absolute value than a predefined maximum energy valve. The predefined maximum energy valve represents a quantity of electrical energy in which a change in the axial position of the nozzle needle and therefore an injection of fluid has not yet taken place.

In a further embodiment, during or after the adaptation pass in which the predefined threshold value is reached or exceeded in absolute value, an energy offset value is determined as a function of the quantity of electrical energy which is assigned to this adaptation pass, which energy offset value is taken into account for the actuation of the actuator in order to inject fluid and/or for the actuation of the actuator during subsequent adaptation passes. The quantity of electrical energy which is assigned to the corresponding adaptation pass represents a measure of the energy which is required to open the control valve. The energy offset value which is determined is preferably added in the respective actuation of the actuator to the quantity of electrical energy which is assigned to this actuation.

In a further embodiment, the quantity of electrical energy which is respectively fed to the actuator is increased in successive adaptation passes. The quantity of electrical energy is preferably increased incrementally and therefore permits particularly precise adaptation. After the adaptation pass in which the predefined voltage difference threshold value is reached or exceeded in absolute value, the first adaptation pass is preferably started again.

In a further embodiment, the injection valve is coupled hydraulically to a high pressure accumulator in order to feed in fluid. The adaptation passes are started if the pressure at which the fluid is stored in the high pressure accumulator has a predefined pressure. This permits particularly precise adaptation of the actuation of the actuator. The pressure in the high pressure accumulator preferably has essentially constantly the predefined pressure.

In a further embodiment, the threshold value is predefined as a function of the predefined pressure. The predefinition of the threshold value as a function of the predefined pressure in the high pressure accumulator permits particularly precise adaptation of the actuation of the actuator.

FIG. 1 illustrates an indirectly driven injection valve 1 in two longitudinal sections. The injection valve 1 can be used, for example, as a fuel injection valve for an internal combustion engine of a motor vehicle.

The injection valve 1 comprises a longitudinal axis L, a nozzle needle 14, a control valve 7 and an actuator 2 which is embodied as a solid actuator. The actuator 2 is preferably embodied as a piezo actuator. The control valve 7 is securely coupled to the actuator 2.

The injection valve 1 comprises a housing body 3 with a diaphragm space 9 and an actuator space 5 in which the actuator 2 is arranged. The injection valve 1 also comprises a nozzle body 16 which comprises a control space 8 and a valve space 12. The nozzle body 16 also comprises injection openings 18 across which fluid is injected into a combustion chamber of the internal combustion engine when the injection valve 1 is opened. The control valve 7 and a spring 10 are arranged in the control space 8, and the nozzle needle 14 is arranged in the valve space 12. The diaphragm space 9 is hydraulically coupled to the control space 8, and the control space 8 is hydraulically coupled to the valve space 12. The control space 8 and the valve space 12 are hydraulically coupled across an inflow 22 to a high pressure accumulator for feeding in fluid. Fluid is stored at a predefined pressure, for example between 200 and 2000 bar, in the high pressure accumulator. During operation of the internal combustion engine, the diaphragm space 9, the control space 8 and the valve space 12 are filled with fluid. The diaphragm space 5 is hydraulically coupled across a return flow 20 to a fluid accumulator, for example a fuel tank.

The actuator 2 is designed to act on the control valve 7 and to control in the process a pressure ratio between the control space 8 and the valve space 12. The movement of the control valve 7 is influenced, on the one hand, by a resulting force ratio owing to the pressure ratio between the control space 8 and diaphragm space 9 and, on the other hand, by the force which is applied to the control valve 7 by the actuator 2.

In a charging phase, a predefined quantity of electrical energy E is applied to the actuator 2, that is to say, for example, the actuator 2 is controlled by means of energy. An actuator current $I_{ACT}$ is applied here to the actuator 2, and the applied quantity of electrical energy E is preferably determined using the mathematical relationship $E=0.5\cdot=\int I_{ACTdt}-U_{ACT}$. An actuator voltage $U_{ACT}$ across the actuator 2 rises and the actuator 2 expands axially owing to the piezoelectric effect and applies an actuator force to the control valve 7. If the actuator force exceeds an opposing force which is dependent on the pressure in the high pressure accumulator and which results from a spring force, which is assigned to the spring 10, and a fluid pressure in the control space 8, the control valve 7 is moved axially and opened. Approximately at this time, the energization of the actuator 2 is interrupted and no further quantity of electrical energy is fed in. At this time t2, a holding phase starts in which the fluid pressure in the control space 8 decreases. The nozzle needle 14 is lifted up owing to the pressure difference and opens the injection openings 18 in order to inject fluid. In order to terminate the injection, the actuator 2 is discharged and therefore the quantity of electrical energy E which is stored in the actuator 2 is dissipated. The actuator 2 contracts and therefore moves the control valve 7 axially with the effect of closing it. Fluid continues to be fed to the control space 8 across the inflow 22, and the fluid pressure in the control space 9 is increased again and the nozzle needle 14 is correspondingly moved axially in such a way that it ultimately closes and therefore ends the injection of fluid.

Figure 2:
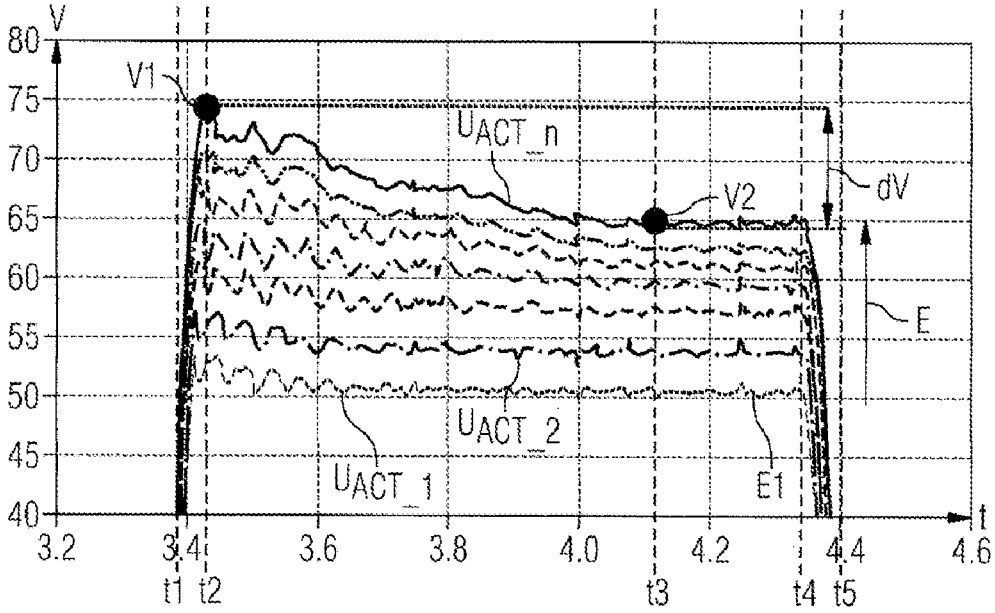
FIG. 2 shows profiles of actuator voltages.

In FIG. 2, a plurality of different voltage profiles of an actuator voltage $U_{ACT}$ across the actuator 2 are represented as a function of the time t. A first voltage profile $U_{ACT_1}$ represents a first adaptation pass and an n-th voltage profile $U_{ACT_n}$ represents an n-th adaptation pass. The charging phase is represented by the time period between the times t1 and t2, the holding phase by the time period between the times t2 and t4, and the discharging phase by the time period between the times t4 and t5.

During the respective holding phase, a first and a second voltage value V1, V2 across the actuator 2 are detected. Therefore, the first voltage value V1 is preferably detected directly after the charging phase, i.e. at the start of the holding phase. The second voltage value V2 is preferably detected at the time t3 at which an oscillation of a movement of the control valve 7 which is assigned to the effect by the actuator 2, has essentially decayed, i.e. at which pressure equalization has taken place between the control space 8 and the diaphragm space 9. For this purpose, the voltage across the actuator 2 is observed or the device waits for a predefined time period after the detection of the first voltage value V1. A voltage difference value dV is determined as a function of the first and second voltage values V1, V2.

Pressure equalization between the control space 8 and diaphragm space 9 takes place only when the actuator 2 opens the control valve 7 at least to a small degree; otherwise, the force ratios at the actuator 2 essentially do not change. The voltage difference value dV is representative of a change in force at the actuator 2 in the time interval between the detections of the two voltage values V1, V2. The change in force at the actuator 2 is caused, for example, by changed pressure ratios between the control space 8 and the diaphragm space 9. Assuming a constant pressure in the high pressure accumulator, this means that for this purpose the control valve 7 was at least partially opened.

During a respective first adaptation pass, the quantity of electrical energy E which is fed to the actuator 2 is preferably predefined in such a way that the control valve 7 remains unaffected, preferably closed. In the subsequent adaptation passes, the quantity of electrical energy E which is respectively fed to the actuator 2 is increased incrementally, for example by a predefined quantity of energy dE.

The voltage difference value dV is compared with a predefined threshold value dV_TH and at least one actuation of the actuator 2 for injecting fluid is adapted as a function of the comparison.

The threshold value dV_TH is predefined here as a function of the pressure in the high pressure accumulator.

Figure 7:
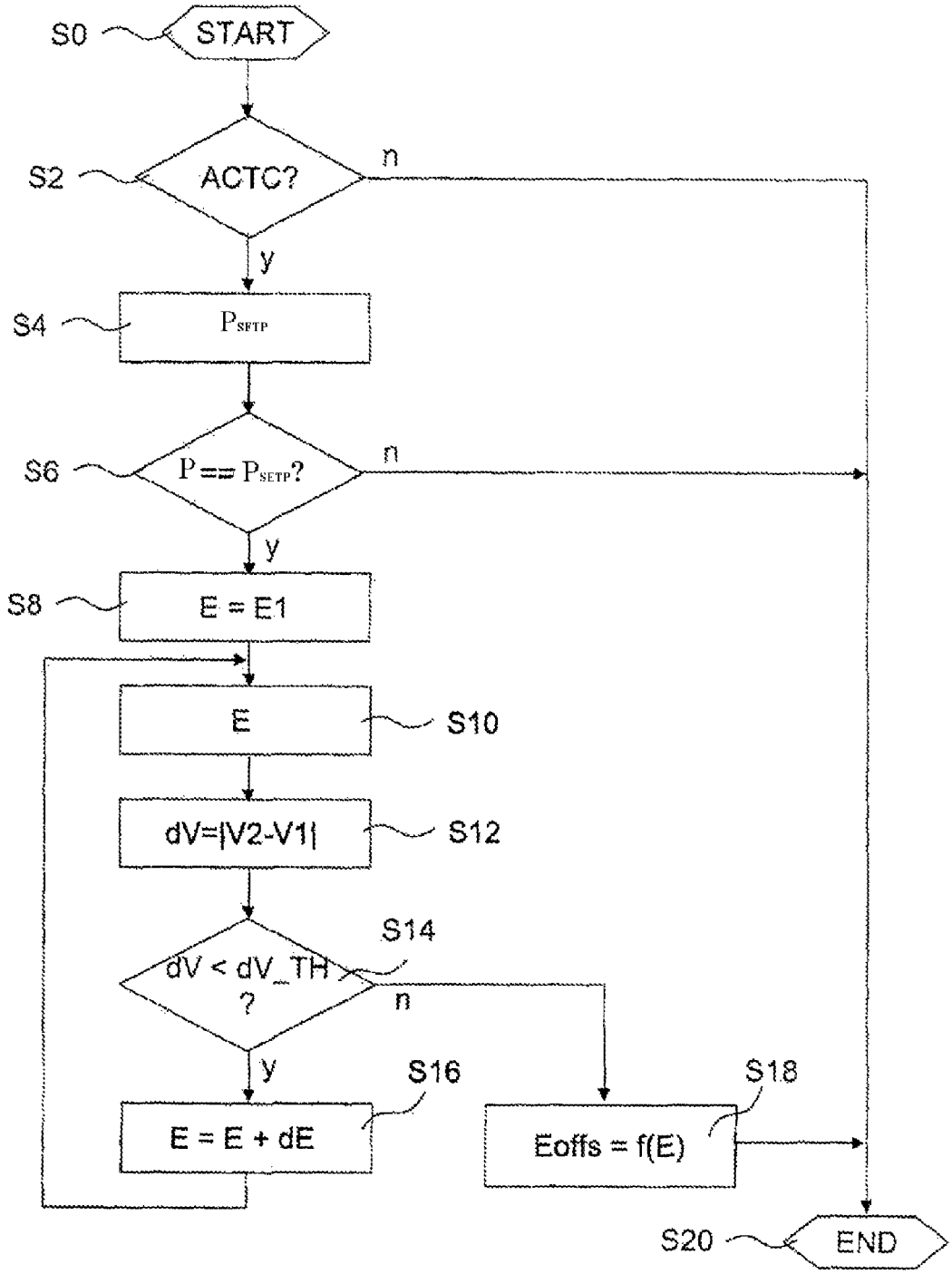
FIGS. 7, 8 are flowcharts.

On the basis of the FIG. 7, a method for operating the injection valve 1 is explained, said method being processed, for example, by means of a control unit of the motor vehicle. Such a control unit can also be referred to as a device for operating the injection valve.

In a step S0, the method is started. In a step S2 it is checked whether a predefined operating state ACTC of the internal combustion engine is present, for example an overrun operating mode or between regular injection phases etc. If this operating state ACTC is not present, the method is ended in a step S20. If the operating state ACTC is present, in a step S4 the pressure in the high pressure accumulator is first set to a predefined pressure $P_{SETP}$, for example to 800 or 1600 bar, for example by means of activation of a pressure control valve of the high pressure accumulator. In a step S6 it is checked whether the predefined pressure value $P_{SETP}$ in the high pressure accumulator is reached. If this condition is not met, the method is ended in the step S20. Alternatively the step S4 can be carried out again. If the condition in the step S6 is met, in a step S8 the quantity of electrical energy E which is fed into the actuator 2 is initialized to a first predefined quantity of electrical energy E1, for example 7.7 mJ. In a step S10, the first predefined quantity of electrical energy E1 is then fed to the actuator 2 in the first adaptation pass. The step S10 represents here the charging phase of the respective adaptation pass. In a step S12, i.e. after the charging phase and therefore during the holding phase, the first and second voltage values V1, V2 across the actuator 2 are detected and as a function thereof the voltage difference value dV is determined. In a step S14, the voltage difference value dV is compared with the predefined threshold value dV_TH, wherein the threshold value dV_TH is predefined as a function of the pressure $P_{SETP}$ which is set in the step S4. If the voltage difference value dV is smaller in absolute value than the threshold value dV_TH, in a step S16, which also represents the discharging phase, the actuator 2 is discharged and the quantity of electrical energy E which is to be fed to the actuator 2 in the following adaptation pass is increased incrementally, for example by the predefined quantity of energy dE, for example 2.2 mJ. The method is continued in the step S10. If the voltage difference value dV is larger than or equal to, in absolute value, the threshold value dV_TH, in a step S18 an energy offset value $E_{OFFS}$ is determined as a function of the quantity of electrical energy E which is fed in in this adaptation pass. Since the energy offset valve $E_{OFFS}$ is typically subject to noise, the energy offset value $E_{OFFS}$ can be low-pass-filtered in the step S18. The energy offset value $E_{OFFS}$ represents a quantity of electrical energy which is to be fed to the actuator 2 and which is required to open the control valve 7, and said energy offset value $E_{OFFS}$ is added to a quantity of electrical energy which is predefined for the actuation of the injection valve 1 for the injection of fluid. In addition, the energy offset value $E_{OFFS}$ is also taken into account for subsequent adaptation passes of the respective quantity of electrical energy E. In the step S20, the method is ended or alternatively carried out again in the step S2.

Figure 8:
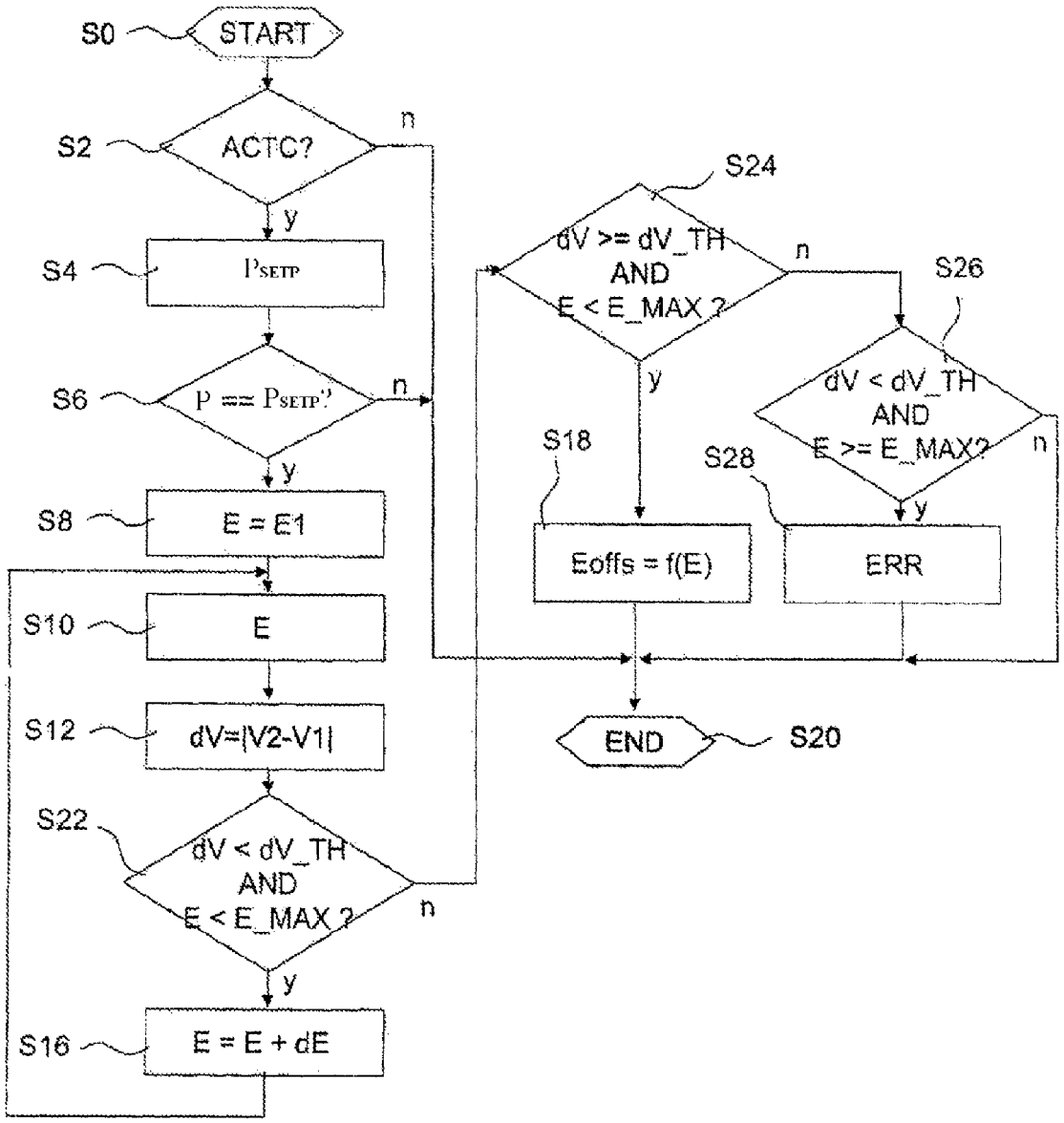

Expansion of the method is illustrated on the basis of FIG. 8. The steps S0 to S12 and S16 to S20 are carried out in a way which is analogous to the corresponding steps according to FIG. 8.

In a step S22, the determined voltage difference value dV is compared with the threshold value dV_TH and the quantity of electrical energy E which is fed to the actuator 2 in the respective adaptation pass is compared with a maximum energy value E_MAX. If the determined voltage difference value dV is smaller in absolute value than the threshold value dV_TH and if the corresponding quantity of electrical energy E is smaller in absolute value than the maximum energy value E_MAX, the method is continued in the step S16. If the condition in the step S22 is not met, in a step S24 a comparison is carried out again, wherein in said comparison, in comparison with the step S22, it is checked whether the voltage difference value dV is larger than or equal to, in absolute value, the threshold value dV_TH. If this condition is met, the method is continued in the step S18. If the condition in the step S24 is not met, in a step S26 a third comparison is carried out in which, in comparison with the step S22, it is checked whether the quantity of electrical energy E which is fed in is larger than or equal to, in absolute valve, the maximum energy value E_MAX. If this condition is met, in a step S28 a fault ERR of the actuator 2 is detected. Since this fault ERR is also typically subject to noise, said fault can be subjected to low-pass filtering and/or debounced. If the condition in the step S26 is not met, the method in the step S20 is ended or alternatively carried out again in the step S2.

Figure 3:
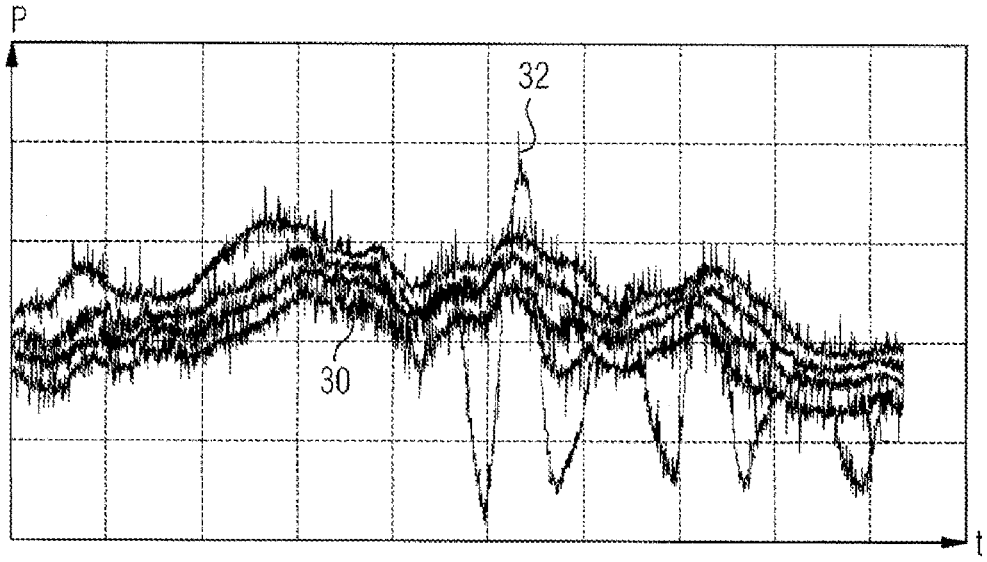
FIG. 3 shows the profile of a pressure in the high pressure accumulator.

In FIG. 3, different pressure profiles of the pressure in the high pressure accumulator are represented as a function of the time t. A first pressure profile 30 represents the pressure profile of the pressure in the high pressure accumulator during the adaptation passes, i.e. without the injection of fluid. A second pressure profile 32 represents a pressure profile of the pressure in the high pressure accumulator during the injection of fluid.

Figure 4:
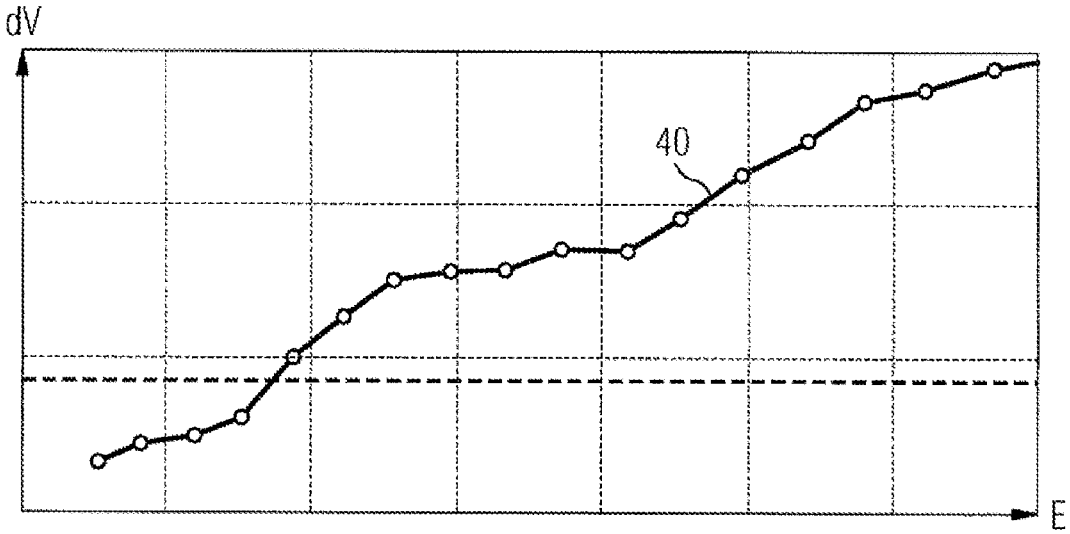
FIG. 4 shows the profile of a voltage difference value.

FIG. 4 illustrates a first profile 40 of the voltage difference value dV as a function of the fed in quantities of electrical energy E during the adaptation passes. From FIG. 4 it is apparent that as the quantity of electrical energy E which is fed in increases, the voltage difference value dV rises. In this context, the rising voltage difference values dV represent increasing changes in force at the actuator 2.

Figure 5:
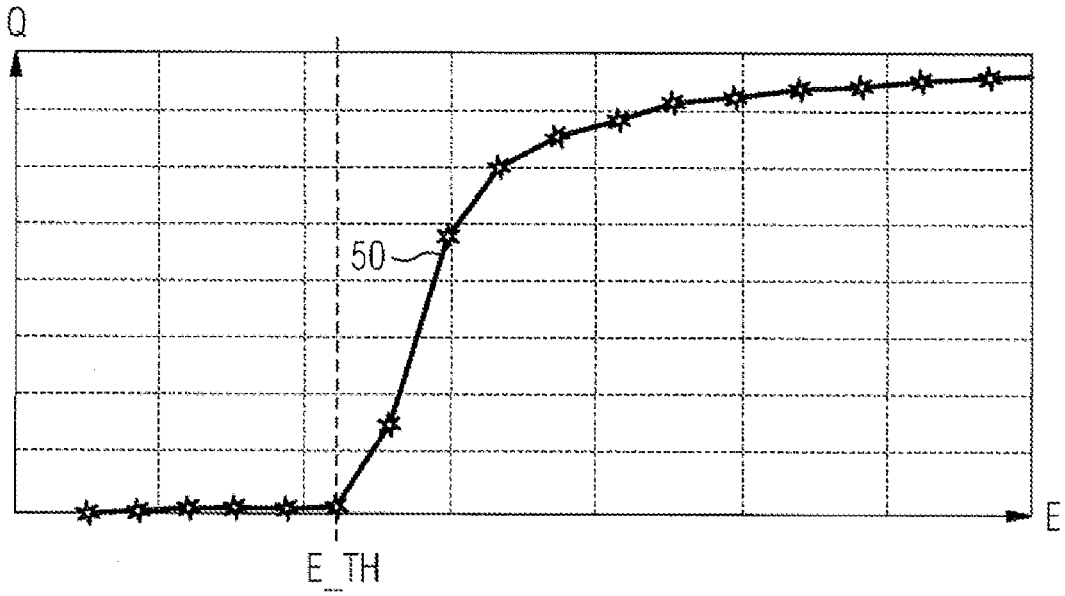
FIG. 5 shows the profile of an injection quantity.

FIG. 5 illustrates a first profile 50 of an injection quantity as a function of the fed in quantities of electrical energy E. Fluid is injected by means of the injection valve 1 starting from an energy threshold value E_TH which is assigned to the respective injection valve and which is, for example, in absolute value slightly above the maximum energy value E_MAX. Since the quantity of electrical energy E which is assigned to the respective adaptation pass is lower than the energy threshold value E_TH, no injection occurs during the adaptation passes.

Figure 6A:
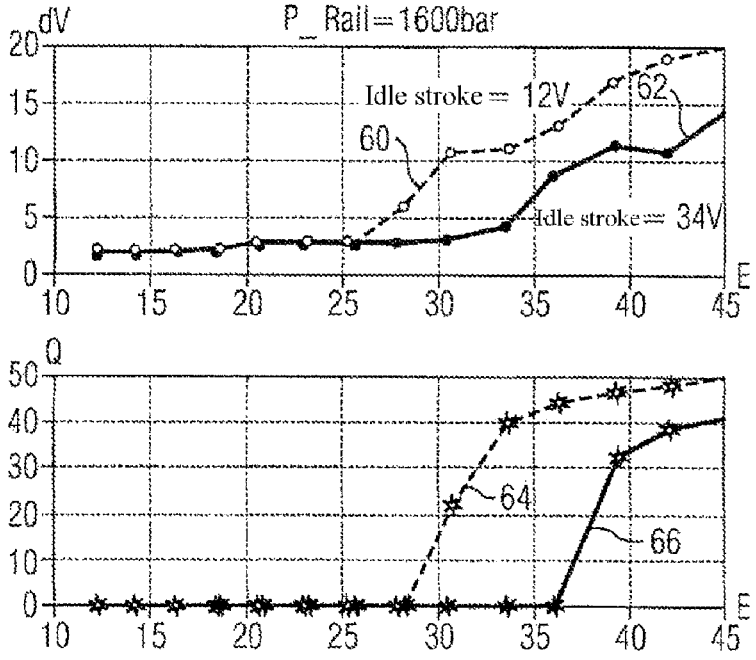
FIGS. 6*a*, 6*b* show profiles of different voltage values and injection quantities.
Figure 6B:
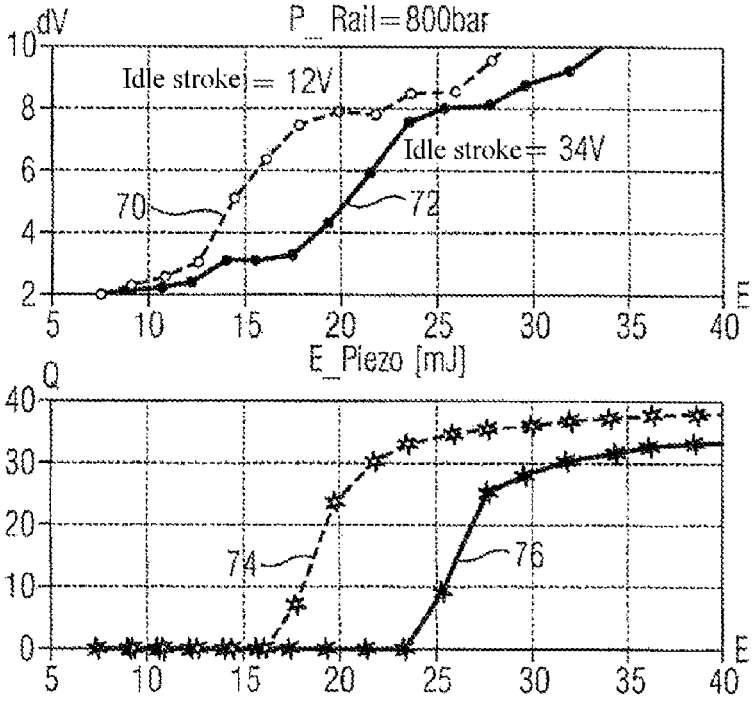

FIGS. 6*a* and 6*b* each illustrate further profiles of the voltage difference values dV which are determined and further profiles of the assigned injection quantities for different pressures in the high pressure accumulator, for example 800 and 1600 bar. These profiles illustrate how the respective profile of the voltage difference values and the respective profile of the injection quantities changes by taking into account the determined energy offset value $E_{OFFS}$, represented by an idle stroke voltage 12 V and 34 V.

If an injection system with a plurality of injection values is present, adaptation can be carried out for each individual injection value. As a result, precise and reliable injection of fluid is made possible.

The adaptation of the actuation of the respective actuator can also be applied in complex hydraulic systems in which there is no direct relationship between the pressure in the high pressure accumulator and the injection of fluid.

What is claimed is:

1. A method for operating an indirectly-driven injection valve having a longitudinal axis, a nozzle needle in a valve space, a control valve in a control space and an actuator which is embodied as a solid actuator in an actuator space, wherein the actuator is designed to act on the control valve, and the control valve is designed to act on the nozzle needle, wherein the nozzle needle is designed to prevent, in a closed position, a flow of fluid through at least one injection opening and otherwise to enable the flow of fluid, the method comprising:

feeding different predefined quantities of electrical energy to the actuator in a plurality of adaptation passes in order to change an axial length of the actuator, for each respective adaptation pass:

after the predefined quantity of electrical energy which is assigned to the respective adaptation pass has been fed in, detecting a first and second voltage value across the actuator, determining a voltage difference value as a function of the first and second voltage values, and comparing the voltage difference value with a predefined threshold value for that respective adaptation pass, determining, for a particular adaptation pass, that the voltage difference value is less than the predefined threshold value, which indicates that axial position of the nozzle needle remains unchanged throughout the feeding of the predefined quantity of electrical energy, and in response to such determination, discharging the actuator and executing a subsequent adaptation pass using a different predefined quantity of electrical energy, such that the particular adaptation pass involves electrically charging and discharging the actuator without causing an axial movement of the nozzle needle, and determining, for the subsequent adaptation pass, that the voltage difference value is greater than or equal to the predefined threshold value, and in response to such determination:

determining an energy offset value based on the predefined quantity of electrical energy assigned to that respective adaptation pass, and adapting at least one actuation of the actuator for injecting fluid as a function of the determined energy offset value.

2. The method according to claim 1, wherein, in a way which correlates with the respective adaptation pass, in succession during a charging phase the predefined quantity of electrical energy which is assigned to the respective adaptation pass is fed to the actuator, during a holding phase for a predefined time period the feeding in of a further quantity of electrical energy is stopped, wherein the first and second voltage values are detected during the holding phase, and the actuator is discharged during a discharge phase.

3. The method according to claim 1, wherein the first voltage value is detected at a first time which is directly after the charging phase.

4. The method according to claim 1, wherein the second voltage value is detected at a second time at which an oscillation of a movement of the control valve which is excited by means of the actuator has essentially decayed during the holding phase.

5. The method according to claim 1, wherein a fault in the actuator is detected if the determined voltage difference is smaller in absolute value than the predefined threshold value and if the quantity of electrical energy which is fed to the actuator is larger in absolute value than a predefined maximum energy value.

6. The method according to claim 1, wherein, during or after the adaptation pass in which the predefined threshold value is reached or exceeded in absolute value, an energy offset value is determined as a function of the quantity of electrical energy which is assigned to this adaptation pass, which energy offset value is taken into account for the actuation of the actuator in order to inject fluid and/or for the actuation of the actuator during subsequent adaptation passes.

7. The method according to claim 1, wherein the quantity of electrical energy which is respectively fed to the actuator is increased in successive adaptation passes.

8. The method according to claim 1, wherein the injection valve is coupled hydraulically to a high pressure accumulator in order to feed in fluid, wherein the adaptation passes are started if the pressure at which the fluid is stored in the high pressure accumulator has a predefined pressure.

9. The method according to claim 8, wherein, during the adaptation passes, the pressure in the high pressure accumulator remains constant.

10. The method according to claim 8, wherein the threshold value is predefined as a function of the predefined pressure.

11. A device for operating an injection valve having a longitudinal axis, a nozzle needle in a valve space, a control valve in a control space and an actuator which is embodied as a solid actuator in an actuator space, wherein the actuator is designed to act on the control valve, and the control valve is designed to act on the nozzle needle, wherein the nozzle needle is designed, in a closed position, to prevent a flow of fluid through at least one injection opening and otherwise to enable the flow of fluid, wherein the device is configured to feed different predefined quantities of electrical energy to the actuator in a plurality of adaptation passes, in order to change an axial length of the actuator, for each respective adaptation pass:

to detect a first and second voltage value across the actuator in a way which correlates with the respective adaptation pass after the predefined quantity of electrical energy which is assigned to the respective adaptation pass has been fed in, to determine a voltage difference value as a function of the first and second voltage values, to compare the voltage difference value with a predefined threshold value for that respective adaptation pass, to determine, for a particular adaptation pass, that the voltage difference value is less than the predefined threshold value, which indicates that axial position of the nozzle needle remains unchanged throughout the feeding of the predefined quantity of electrical energy, and in response to such determination, to discharge the actuator and executing a subsequent adaptation pass using a different predefined quantity of electrical energy, such that the particular adaptation pass involves electrically charging and discharging the actuator without causing an axial movement of the nozzle needle, and to determine, for the subsequent adaptation pass, that the voltage difference value is greater than or equal to the predefined threshold value, and in response to such determination:

to determine an energy offset value based on the predefined quantity of electrical energy assigned to that respective adaptation pass, and to adapt at least one actuation of the actuator for injecting fluid as a function of the determined energy offset value.

12. The device according to claim 11, wherein, in a way which correlates with the respective adaptation pass, the device is further configured in succession to feed during a charging phase the predefined quantity of electrical energy which is assigned to the respective adaptation pass to the actuator, to stop during a holding phase for a predefined time period the feeding in of a further quantity of electrical energy, wherein the first and second voltage values are detected during the holding phase, and to discharge the actuator during a discharge phase.

13. The device according to claim 11, wherein the first voltage value is detected at a first time which is directly after the charging phase.

14. The device according to claim 11, wherein the second voltage value is detected at a second time at which an oscillation of a movement of the control valve which is excited by means of the actuator has essentially decayed during the holding phase.

15. The device according to claim 11, wherein a fault in the actuator is detected if the determined voltage difference is smaller in absolute value than the predefined threshold value and if the quantity of electrical energy which is fed to the actuator is larger in absolute value than a predefined maximum energy value.

16. The device according to claim 11, wherein, during or after the adaptation pass in which the predefined threshold value is reached or exceeded in absolute value, an energy offset value is determined as a function of the quantity of electrical energy which is assigned to this adaptation pass, which energy offset value is taken into account for the actuation of the actuator in order to inject fluid and/or for the actuation of the actuator during subsequent adaptation passes.

17. The device according to claim 11, wherein the quantity of electrical energy which is respectively fed to the actuator is increased in successive adaptation passes.

18. The device according to claim 11, wherein the injection valve is coupled hydraulically to a high pressure accumulator in order to feed in fluid, wherein the adaptation passes are started if the pressure at which the fluid is stored in the high pressure accumulator has a predefined pressure.

19. The device according to claim 18, wherein, during the adaptation passes, the pressure in the high pressure accumulator remains constant.

20. The device according to claim 18, wherein the threshold value is predefined as a function of the predefined pressure.

* * * * *